US006883185B2

(12) United States Patent
Duncan

(10) Patent No.: US 6,883,185 B2
(45) Date of Patent: Apr. 26, 2005

(54) SURVIVAL SUIT

(76) Inventor: Robert R. Duncan, P.O. Box 190746, Anchorage, AK (US) 99519-0746

( * ) Notice: Subject to any disclaimer, the term of this patent is extended or adjusted under 35 U.S.C. 154(b) by 8 days.

(21) Appl. No.: 10/642,008

(22) Filed: Aug. 15, 2003

(65) Prior Publication Data

US 2004/0031090 A1 Feb. 19, 2004

Related U.S. Application Data

(60) Provisional application No. 60/404,035, filed on Aug. 16, 2002.

(51) Int. Cl.[7] ..... A62B 17/00; B63C 9/087

(52) U.S. Cl. ..... 2/458; 2/82; 441/104

(58) Field of Search ..... 2/456, 458, 2.16, 2/DIG. 3, 82; 128/201.11, 201.29, 202.11; 441/102, 103, 104, 105

(56) References Cited

U.S. PATENT DOCUMENTS

| | | | | | |
|---|---|---|---|---|---|
| 128,971 | A | | 7/1872 | Merriman | |
| 1,102,772 | A | | 7/1914 | Lyman | |
| 1,180,839 | A | * | 4/1916 | Gilbert | 441/105 |
| 1,314,299 | A | * | 8/1919 | Zaccard et al. | 441/103 |
| 1,372,469 | A | * | 3/1921 | Zeleznoff | 441/102 |
| 1,813,965 | A | | 7/1931 | Sferrazza | |
| 2,761,154 | A | | 9/1956 | Horiuchi | 9/20 |
| 2,782,430 | A | | 2/1957 | Radnofsky | 9/20 |
| 3,138,155 | A | | 6/1964 | Bould | 128/144 |
| 3,245,095 | A | | 4/1966 | Barnier | 9/331 |
| 3,369,263 | A | | 2/1968 | Kreckl | 9/331 |
| 3,721,236 | A | * | 3/1973 | Bardehle | 128/201.11 |
| 4,029,092 | A | * | 6/1977 | Morgan | 128/201.11 |
| 4,294,242 | A | * | 10/1981 | Cowans | 128/201.13 |
| 4,301,791 | A | | 11/1981 | Franco, III | 128/89 R |
| 4,563,157 | A | | 1/1986 | Hoshino | 441/104 |
| 4,599,075 | A | * | 7/1986 | Nygard | 441/103 |
| 4,633,526 | A | | 1/1987 | Richardson | 2/2.1 R |
| 4,704,092 | A | | 11/1987 | Liukko | 441/104 |
| 6,206,744 | B1 | * | 3/2001 | Wigutow | 441/88 |
| 6,415,453 | B1 | * | 7/2002 | Anderson et al. | 2/458 |

* cited by examiner

*Primary Examiner*—Rodney M. Lindsey
(74) *Attorney, Agent, or Firm*—Dean A. Craine

(57) ABSTRACT

A survival suit including two inner bladders filled with air exhaled from the user to provide warmth and floatation. The first inner bladder is located against the user's back that covers the entire dorsal region. Located behind the first inner bladder is a second inner bladder that acts as an insulation layer when submerged under water. Both the first and second inner bladders are filled with fibrous filler material to provide insulation and allow exhaled air to flow freely therein. An air conduit extends from the user's mouth to the second inner bladder. Formed between the first and second inner bladders is an air passageway that delivers air from the second inner bladder into the first inner bladder. Air outlet ports located on the first inner bladder allows exhaled air to escape into the body cavity and that completely surround the user. The exhaled air in the body cavity eventually escapes through the face opening.

20 Claims, 6 Drawing Sheets

SURVIVAL SUIT

This is a utility patent application which claims benefit of U.S. Provisional Application No. 60/404,035 filed on Aug. 16, 2002.

BACKGROUND OF THE INVENTION

1. Field of the Invention

The present invention relates generally to the field of survival suits designed to protect wearers exposed to cold environments and, more particularly, to survival suits designed to float when placed in water.

2. Description of the Related Art

Crewmembers on a ship often wear heavy, insulated work clothing to keep them warm. Often, the work clothing includes an inflatable collar that the crewmember selectively inflates when he is thrown involuntarily into the waves. If the crewmember is not removed from the cold water in a few minutes, hypothermia sets in shortly which may lead to death. When a crewmember knows that the ship is sinking and will be forced to enter the water shortly, he or she will immediately put on a survival suit that offers more protection against hypothermia.

Typical survival suits are bulky, full-body suits made of one thick, heavy layer of waterproof material. Some survival suits include an inflating neck collar that is selectively inflated by the wearer to provide floatation. Unfortunately, survival suits only offer limited protection against hypothermia.

What is needed is an improved survivor suit which offers greater protection against hypothermia.

SUMMARY OF THE INVENTION

It is an object of the present invention to provide an improved survivor suit that offers greater protection against hypothermia.

It is another object of the present invention to provide a survivor suit that uses the exhaled air from the wearer to heat the inside cavities of the suit.

These and other objects of the invention are met by the survivor suit disclosed herein that includes an outer shell that covers the entire body except the face with two, partially closed bladders. During use, the user exhales air into the two bladders which distributes air around a large area of the body directly exposed to cold water and then distributes it into the body cavity.

More specifically, the survival suit includes a one-piece outer shell that includes a head section, a neck section, an upper thoracic section, two arm sections, an abdominal section, and two leg sections. Manufactured in the upper thoracic and abdominal sections is a longitudinally aligned front opening that enables the suit to be opened so that the wearer can easily enter or exit the suit. Formed on the head section is a small face opening which enables the wearer to see and breathe. Formed inside the outer shell is a full-length body cavity. Disposed around the face opening is an optional facemask and snorkel. A means for closing the front opening is also provided so that the face opening is the only entry port into the suit when it is worn.

The suit includes a first inner bladder located inside the outer shell directly behind the wearer when worn. The first inner bladder acts as an insulation layer between the surrounding cold water and the posterior areas of the head, neck, upper and lower torso, and legs. It is filled with fibrous filling material that provides insulation and creates air cavities that allows air to easily flow therethrough.

Located posterior to the first inner bladder is a second inner bladder that acts as a second insulation barrier between the first inner bladder and the back surface of the outer shell. The second inner bladder extends posteriorly over the head, neck and upper torso. The lower edge of the second inner bladder terminates near or at the wearer's waist or upper buttocks region. Like the first inner bladder, the second bladder is filled with fibrous filling material that provides insulation and creates air cavities that allows air to easily flow therethrough.

Located in the mouth region of the head section of the suit is a mouthpiece connected to a ventilation tube that extends downward inside the body cavity to the second inner bladder. A plurality of air holes is formed on the section of ventilation tube located inside the second inner bladder to reduce back pressure when exhaling air into the mouthpiece. During use, exhaled air is delivered to the second inner bladder and then travels through an air passageway formed between the first and second inner bladders. The exhaled air then travels through the first inner bladder and eventually escapes into the body cavity through outlet ports located on the first inner bladder near the user's feet when the suit is worn. Once the exhaled air is deposited into the body cavity, the exhaled air travels up and around the user's legs, torso, neck and head sections to provide warmth to these areas and then exits the suit through the face opening.

In a second embodiment, the sides of the first inner bladder bend and extend laterally around the sides of the user to provide thermal protection up to the water line on the suit when the wearer is floating horizontally in the water.

One benefit of inflating the suit is that the suit is more rigid and protects the wearer from rough wave action. A benefit of using exhaled air to inflate the suit is that a large thermal target or signature is created that enables rescuers wearing infrared vision goggles to see the wearer in the water.

DESCRIPTION OF THE PREFERRED EMBODIMENT(S)

Figure 1:
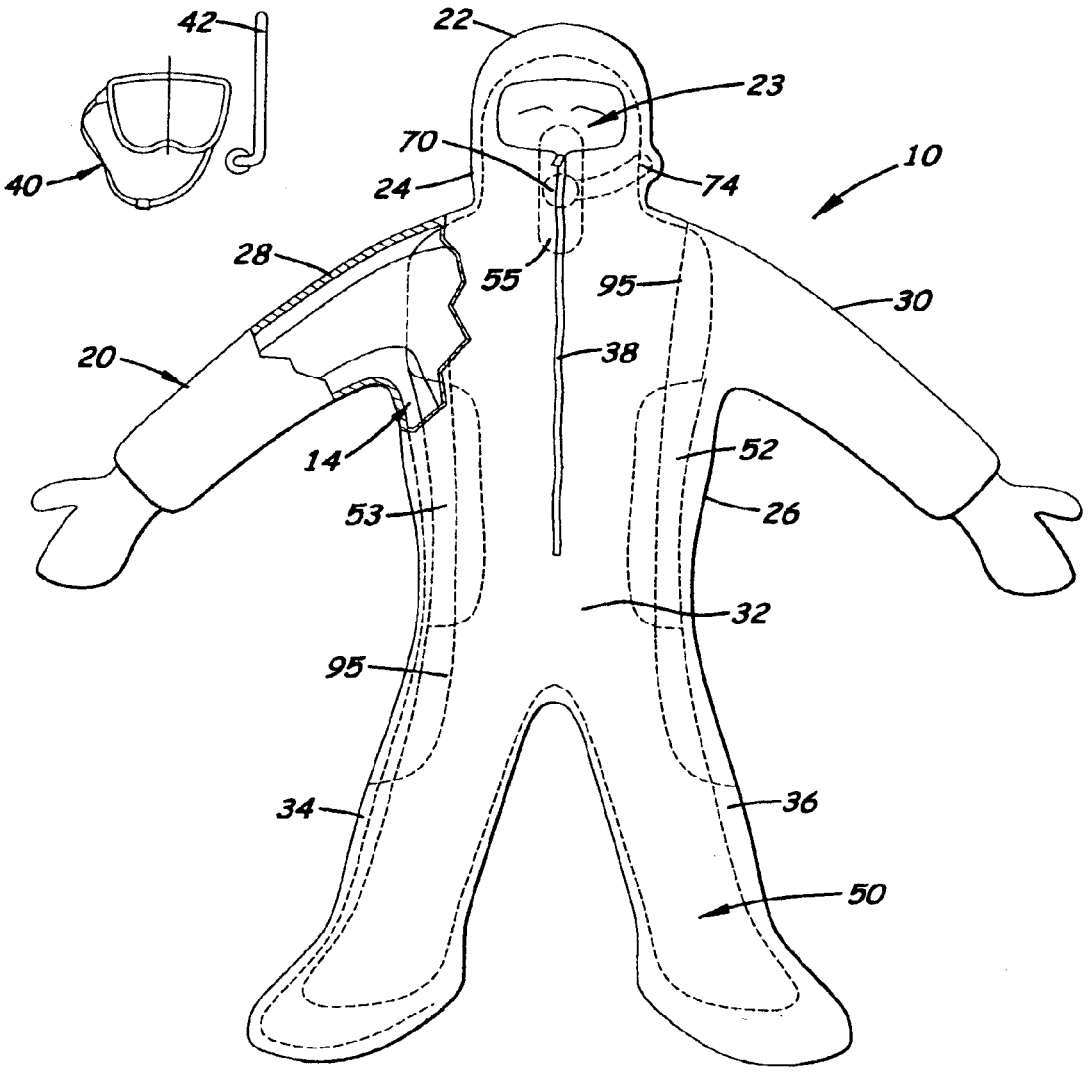
FIG. 1 is a front plan view of the survival suit disclosed herein showing the relative location of the first inner bladder.
Figure 2:
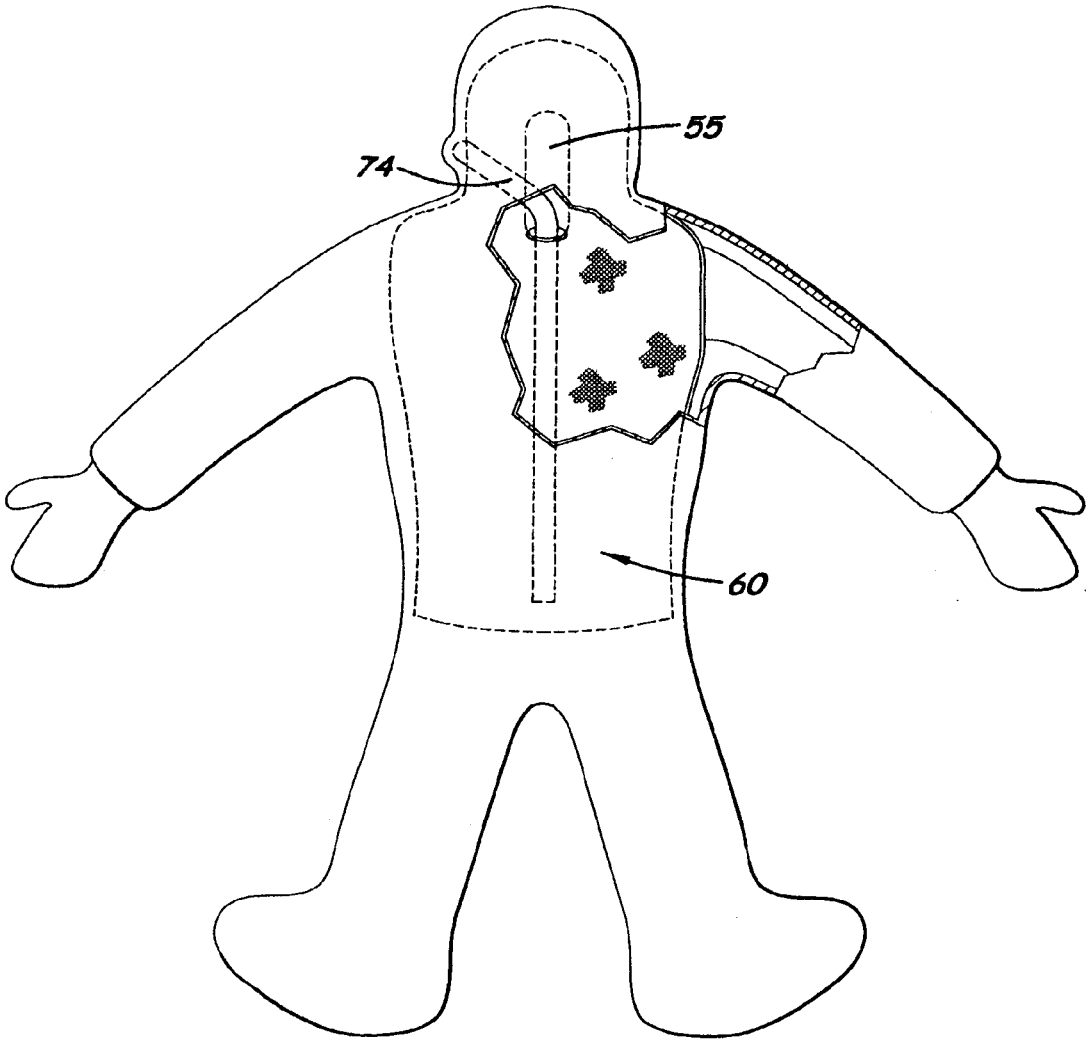
FIG. 2 is a rear plan view of the survival suit showing the relative location of the second inner bladder.
Figure 3:
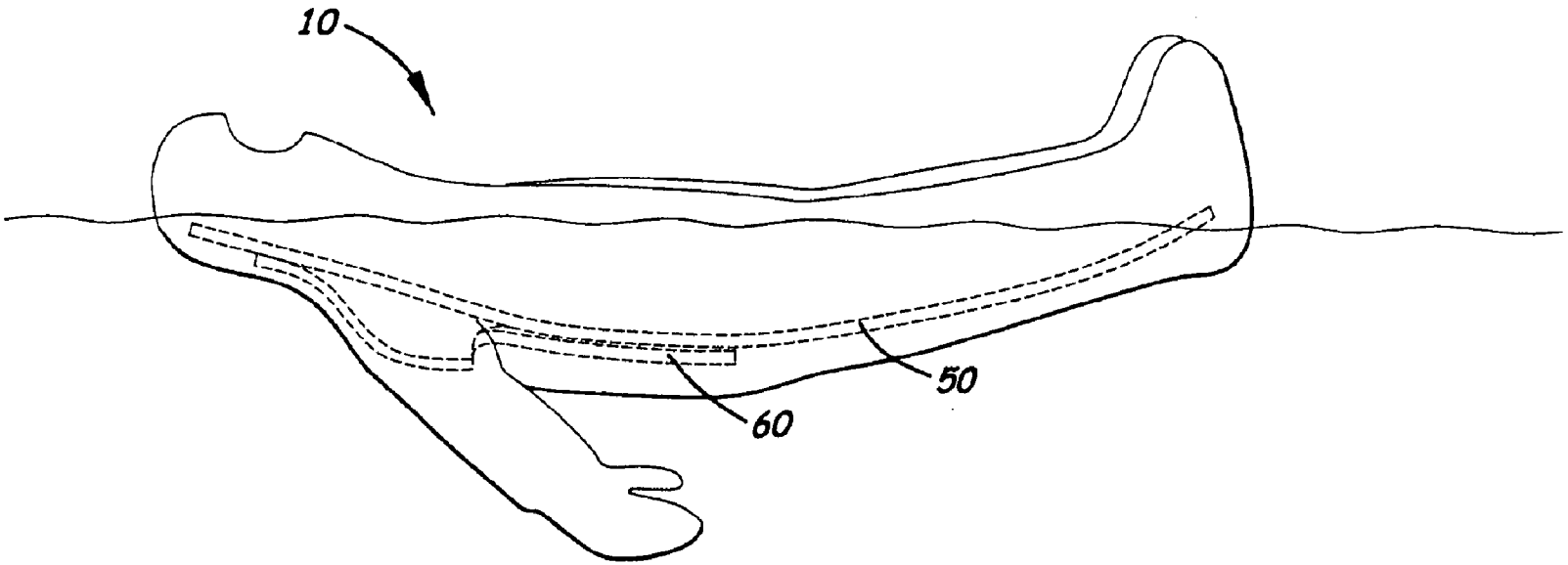
FIG. 3 is a side elevation view of the survival suit showing a wearer lying in a horizontal position in water.
Figure 4:
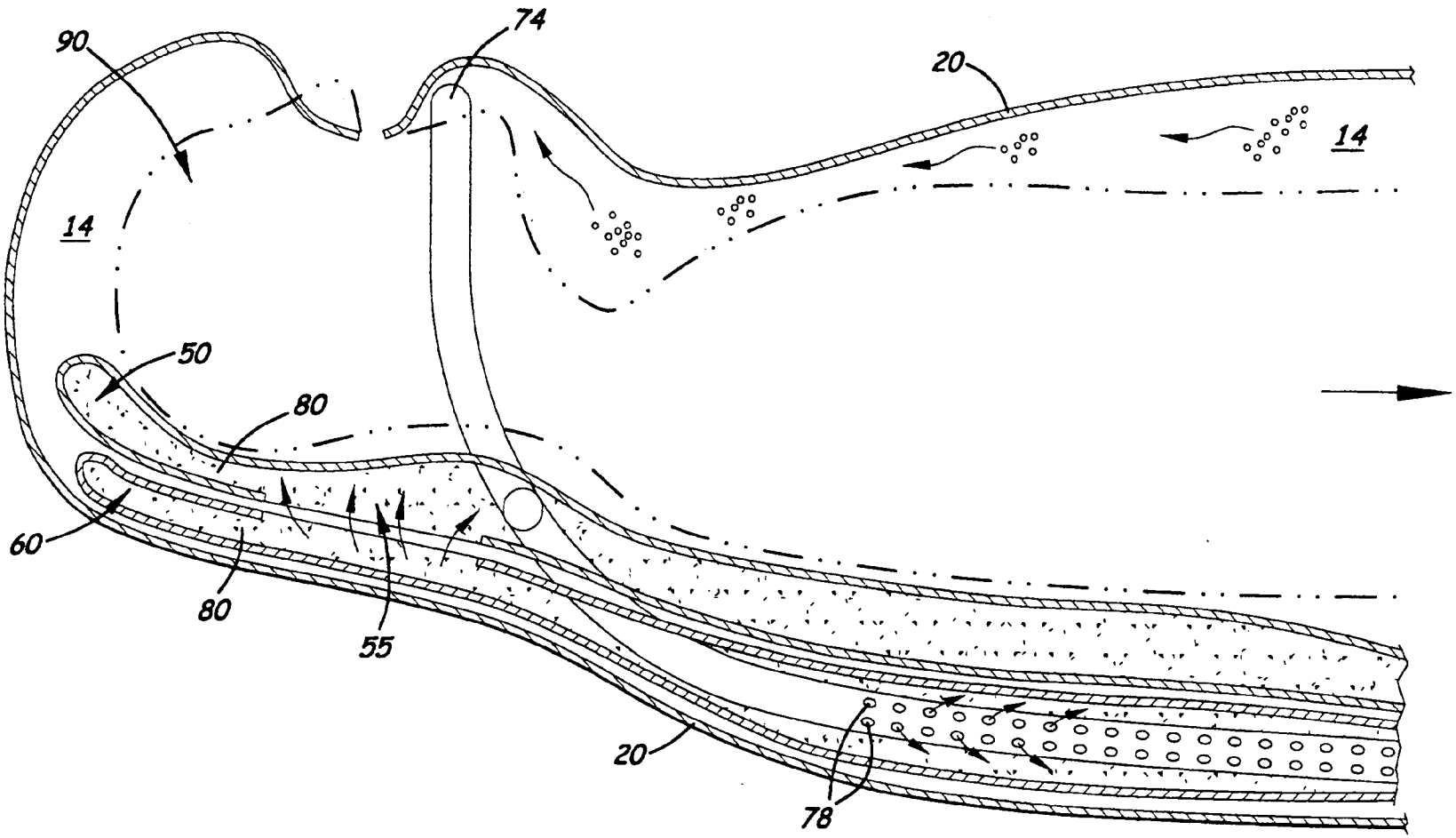
FIGS. 4–6 are sectional, side elevational views of the upper torso region of the survival suit.

There is shown in the accompanying Figs. A survival suit 10 including a one-piece outer shell 20 that includes a head section 22, a neck section 24, an upper thoracic section 26, two arm sections 28, 30, an abdominal section 32, and two leg sections 34, 36. Manufactured in the upper thoracic and abdominal sections 26, 32, respectively, is a longitudinally aligned front opening 38 that enables the suit 10 to be easily opened so that the wearer 90 can enter or exit the suit 10. Formed on the head section 22 is a small face opening 23 which enables the wearer 90 to see and breathe. Disposed around the face opening 23 is an optional facemask 40 and snorkel 42.

The suit 10 includes a first inner bladder 50 located inside the outer shell 20 directly behind the wearer 90 when worn. The first inner bladder 50 acts as an insulation layer that extends from the back of the head, over the back and legs, and to the two ankles. In the preferred embodiment, the first inner bladder 50 does not cover the posterior areas of the arms. It should be understood, however, the first inner bladder 50 may be modified to cover the posterior areas of the upper arms. The first inner bladder 50 is filled with fibrous filling material 80 that provides insulation and creates a plurality of interconnected air cavities to allow air located therein to easily flow therethrough.

Located behind the first inner bladder 50 is a second inner bladder 60 that acts as a second insulation barrier between the first inner bladder 50 and the outer shell 20. The second inner bladder 60 is shorter than the first inner bladder 50 and extends from the back of the head, over the dorsal or back region to the wearer's waist and upper buttocks. Like the first inner bladder 50, the second inner bladder 60 is filled with fibrous filling material 80 that provides insulation and creates an inner air cavity a plurality of interconnected cavities that allow air to flow therethrough.

Located or adjacent to the face opening 23 of the head section 22 is a mouthpiece 70 connected to a flexible ventilation tube 74 that extends around the neck and downward inside the body cavity and along the back. The ventilation tube 74 terminates inside the second inner bladder 60. A plurality of air holes 78 are formed on the section of ventilation tube 74 located inside the second inner bladder 60 to reduce back pressure on the mouthpiece 70. During use, exhaled air is directly delivered to the second inner bladder 60 and then travels through the air passageway 55 formed between the second and first inner bladders 50, 60, respectively. The exhaled air then travels into the first inner bladder 50 and escapes through port openings 58 located near the feet and then into the body cavity 14 formed between the inside surface of the second inner bladder 60 and the outer shell 20. Once deposited into the body cavity 14, the exhaled air travels up and around the upper torso and head and neck sections 22, 24, respectively, to provide heat to these regions. The exhaled air then exits the suit 10 through the face opening 23.

In a second embodiment, the sides 52, 53 of the first inner bladder 50 bend and extend around the sides of the wearer 90 to provide thermal protection up to the waterline 95 on the suit 10 when the wearer 90 is floating horizontally in the water as shown in FIG. 1.

Figure 5:
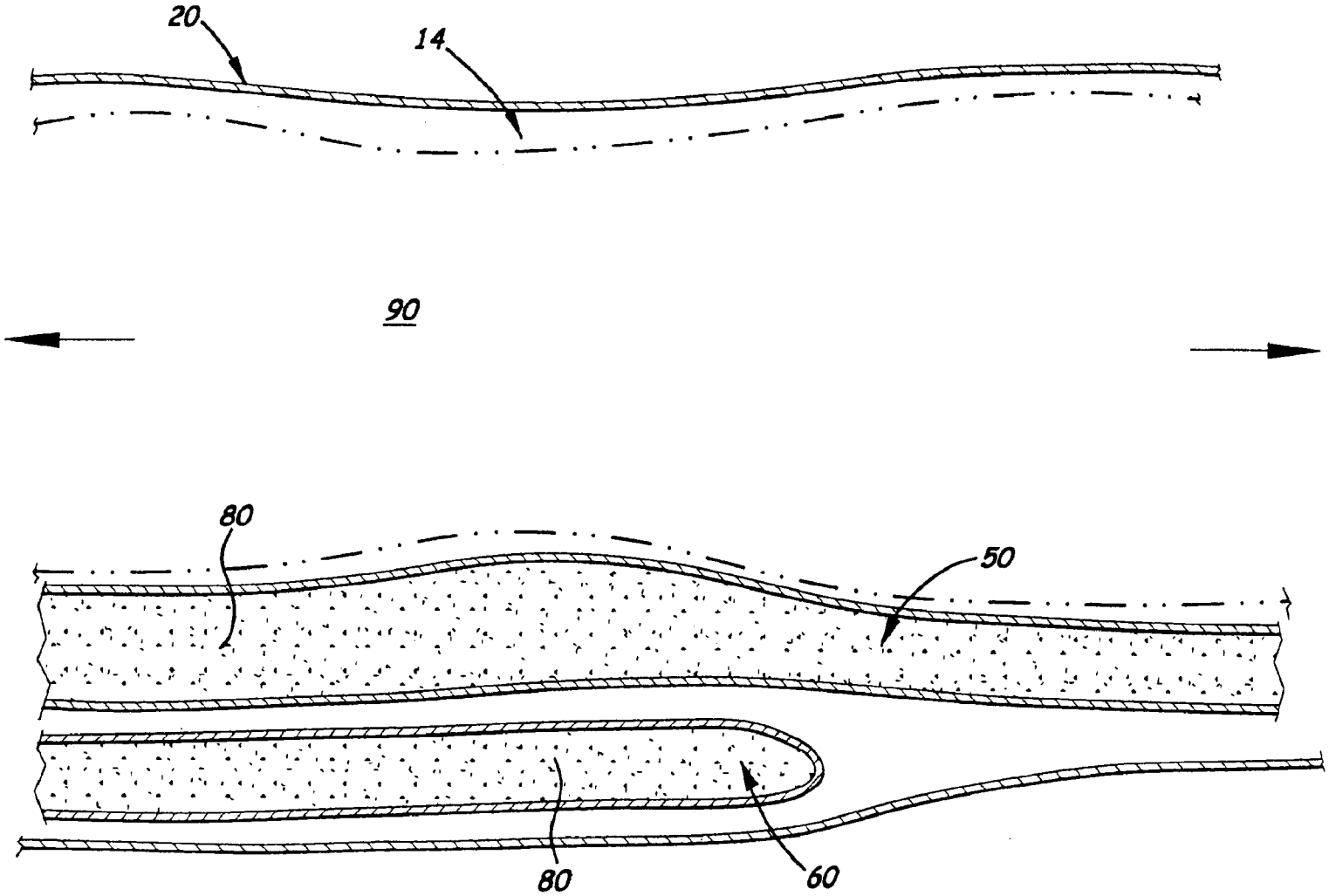
Figure 6:
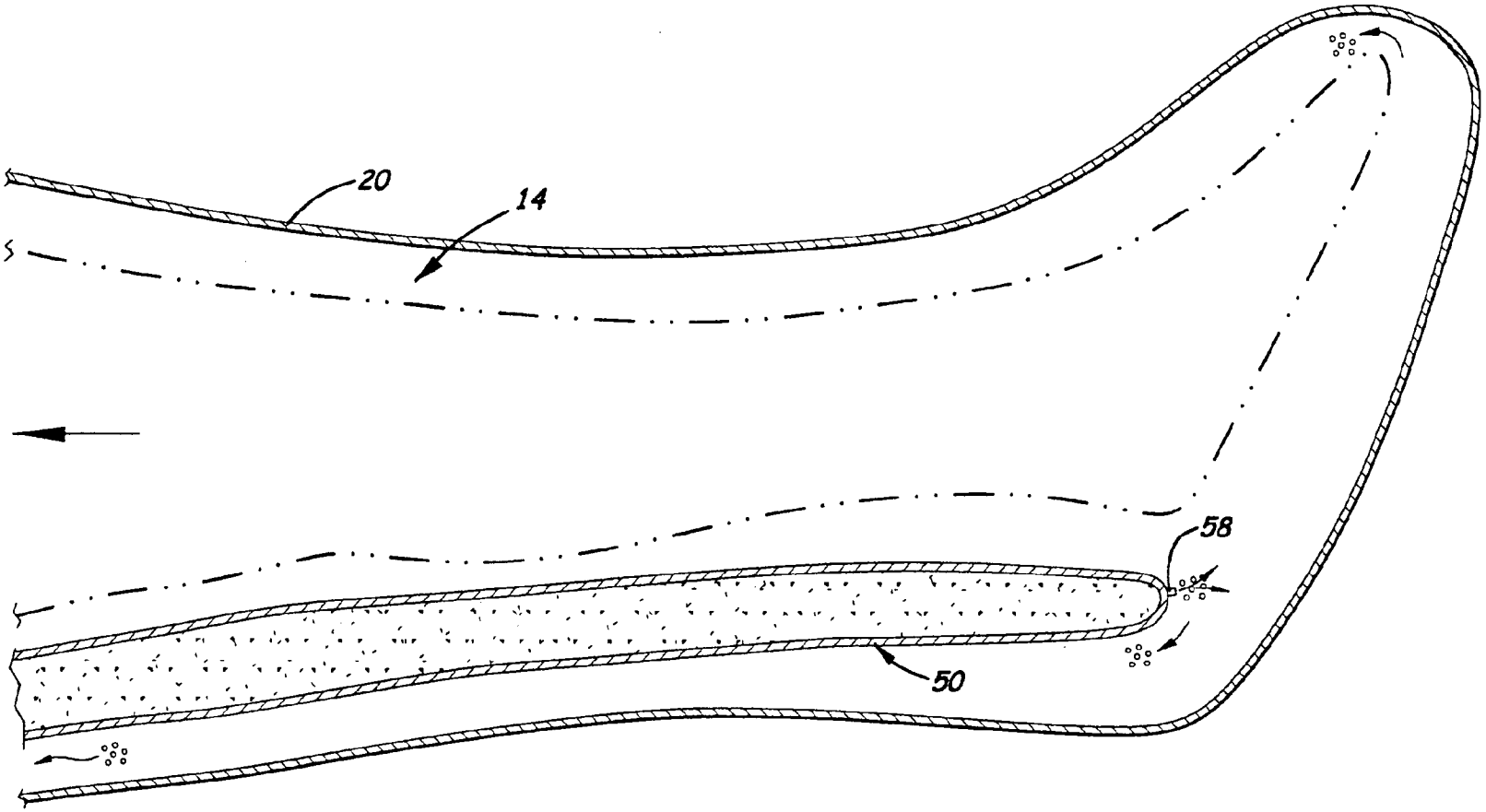

In the preferred embodiment, the outer shell 20 is made of neoprene or urethane backed nylon approximately 3⁄16 to 3⁄8 inches thick. The first and second inner bladders 50, 60, respectively, are also made of neoprene or urethane backed nylon approximately 1⁄8 inch thick. The fibrous filling material 80 is made of loosely twisted nylon fibers. As shown in FIG. 5, the first and second inner bladders 50, 60, respectively, have a uniform thickness over their entire length of approximately 1⁄8 inch.

In compliance with the statute, the invention described herein has been described in language more or less specific as to structural features. It should be understood, however, that the invention is not limited to the specific features shown, since the means and construction shown, is comprised only of the preferred embodiments for putting the invention into effect. The invention is therefore claimed in any of its forms or modifications within the legitimate and valid scope of the amended claims, appropriately interpreted in accordance with the doctrine of equivalents.

I claim:

1. A survival suit, comprising:

a. a watertight, outer shell that includes a head section, a neck section, an upper thoracic section, two arm sections, an abdominal section, two leg sections and a face opening, said outer shell forming an enclosed body cavity and a main opening capable of being selectively opened and closed to allow said outer shell to be worn by a user;

b. a first inner bladder located inside said body cavity and positioned behind a user when said outer shell is worn, said first inner bladder being filled with fibrous filing material that enables air to flow through said first inner bladder and including a plurality of outlet ports that enable air located inside said first inner bladder to escape into said body cavity;

c. a second inner bladder located inside said outer shell and behind said first inner bladder, said second inner bladder being filled with fibrous filing material that enables air to flow through;

d. an air passageway formed between said first inner bladder and said second inner bladder; and, e. an exhalation tube that extends from said face opening to said second inner bladder that is used to deliver exhaled air from a user wearing said suit to said second inner bladder.

2. The survival suit, as recited in claim 1, wherein said first inner bladder includes lateral edges that cover the sides of a user when said suit is worn.

3. The survival suit, as recited in claim 2, wherein said lateral edges of said first inner bladder extend to the waterline mark on said suit when a user is wearing said suit and positioned horizontally in water.

4. The survival suit, as recited in claim 1, wherein said first inner bladder extends posteriorly on said outer shell adjacent to said head section, said neck section, said upper thoracic section, and said abdominal section of said outer shell.

5. The survival suit, as recited in claim 2, wherein said first inner bladder extends posteriorly on said outer shell adjacent to said head section, said neck section, said upper thoracic region, and said abdominal section of said outer shell.

6. The survival suit, as recited in claim 3, wherein said first inner bladder extends posteriorly on said outer shell adjacent to said head section, said neck section, said upper thoracic region, and said abdominal section of said outer shell.

7. The survival suit, as recited in claim 1, wherein said second inner bladder extends posteriorly inside said outer shell and terminates near the waist of a user.

8. The survival suit, as recited in claim 2, wherein said second inner bladder extends posteriorly inside said outer shell and terminates near the waist of a user.

9. The survival suit, as recited in claim 6, wherein said second inner bladder extends posteriorly inside said outer shell and terminates near the waist of a user.

10. The survival suit, as recited in claim 1, wherein a portion of said exhalation tube extends into said second inner bladder and includes a plurality of holes thereby preventing back pressure in said exhalation tube.

11. The survival suit, as recited in claim 2, wherein a portion of said exhalation tube extends into said second inner bladder and includes a plurality of holes thereby preventing back pressure in said exhalation tube.

12. The survival suit, as recited in claim 4, wherein a portion of said exhalation tube extends into said second inner bladder and includes a plurality of holes thereby preventing back pressure in said exhalation tube.

13. The survival suit, as recited in claim 1, wherein said first inner bladder includes leg sections that extend into said leg regions of said outer shell.

14. The survival suit, as recited in claim 2, wherein said first inner bladder includes leg sections that extend into said leg regions of said outer shell.

15. The survival suit, as recited in claim 4, wherein said first inner bladder includes leg sections that extend into said leg regions of said outer shell.

16. The survival suit, as recited in claim 14, wherein said first inner bladder includes a plurality of port openings formed on said leg regions on said first inner bladder thereby enabling exhaled air to escape into said body cavity.

17. The survival suit, as recited in claim 15, wherein said first inner bladder includes a plurality of port openings formed on said leg regions on said first inner bladder thereby enabling exhaled air to escape into said body cavity.

18. The survival suit, as recited in claim 1, further including a mask that fits over said face opening.

19. The survival suit, as recited in claim 3, further including a mask that fits over said face opening.

20. The survival suit, as recited in claim 18, further including a snorkel.

* * * * *